US005356549A

United States Patent [19]

Takahashi et al.

[11] Patent Number: 5,356,549

[45] Date of Patent: Oct. 18, 1994

[54] SILICONE GREASE

[75] Inventors: Takayuki Takahashi, Kanra; Motohiko Hirai, Annaka, both of Japan

[73] Assignee: Shin-Etsu Chemical Co., Ltd., Tokyo, Japan

[21] Appl. No.: 6,286

[22] Filed: Jan. 19, 1993

[30] Foreign Application Priority Data

Jan. 21, 1992 [JP] Japan ..... 4-030106

[51] Int. Cl.[5] ..... C10M 105/76

[52] U.S. Cl. ..... 252/49.6

[58] Field of Search ..... 252/49.6

[56] References Cited

U.S. PATENT DOCUMENTS 4,787,991 11/1988 Morozumi et al. ..... 252/49.6

4,842,753 6/1989 Mori et al. ..... 252/42.7

*Primary Examiner*—John Niebling

*Assistant Examiner*—Edna Wong

*Attorney, Agent, or Firm*—Millen, White, Zelano, & Branigan

[57] ABSTRACT

Silicone grease comprising (A) an amino-modified silicone fluid having an amine equivalent of 10,000 to 200,000 g/mol and a viscosity of 10 to 100,000 cs at 25° C., and (B) a thickener exhibits improved heat resistance and low-temperature resistance.

18 Claims, No Drawings

SILICONE GREASE

BACKGROUND OF THE INVENTION

1. Field of the Invention

This invention relates to a silicone grease having improved heat resistance and low-temperature resistance.

2. Prior Art

Silicone grease contains silicone fluid as a base oil which is increased in viscosity by adding various thickeners and optionally combined with any desired additive to form a paste. Most widely used is grease having dimethylsilicone oil as the base oil. The silicone grease based on dimethylsilicone is used in the temperature range between −50° C. and 170° C. and well resistant against low temperatures, but less resistant against higher temperatures.

Some types of silicone grease known to have higher heat resistance contain methylphenylsilicone and fluorosilicone fluids as the base oil. They are resistant against temperatures of 200° to 250° C., but their low-temperature resistance is limited to −30° C.

There is a need to have a silicone grease having both heat resistance and low-temperature resistance.

SUMMARY OF THE INVENTION

We have found that a silicone grease containing an amino-modified silicone fluid of the general formula (1):

$$R_a^1R_b^2SiO_{(4-a-b)/2} \quad (1)$$

wherein $R^1$ is a group of the formula: $—R^3—NH_2$ or $—R^3—NHR^4—NH_2$ wherein $R^3$ and $R^4$ are independently alkylene groups having 1 to 8 carbon atoms, $R^2$ is a substituted or unsubstituted monovalent hydrocarbon group having 1 to 6 carbon atoms, letters a and b are positive numbers in the range: $0.0001 \leqq a \leqq 0.01$ and $1.95 \leqq a + b \leqq 2.20$, having an amine equivalent of 10,000 to 200,000 g/mol and a viscosity of 10 to 100,000 centistokes (cs) at 25° C. as a base oil can be used in the temperature range between −50° C. and 200° C. Such a grease is significantly improved in heat resistance while maintaining low-temperature resistance unchanged from the conventional silicone grease using dimethylsilicone fluid.

DETAILED DESCRIPTION OF THE INVENTION

The present invention provides a silicone grease comprising (A) an amino-modified silicone fluid of formula (1) having an amine equivalent of 10,000 to 200,000 g/mol and a viscosity of 10 to 100,000 centistokes (cs) at 25° C. as a base oil and (B) a thickener.

$$R_a^1R_b^2SiO_{(4-a-b)/2} \quad (1)$$

In the formula, $R^1$ is a group of the formula:

$$—R^3—NH_2 \text{ or } —R^3—NHR^4—NH_2$$

wherein $R^3$ and $R^4$ which may be identical or different are alkylene groups having 1 to 8 carbon atoms, preferably 2 or 3 carbon atoms.

$R^2$ is a substituted or unsubstituted monovalent hydrocarbon group having 1 to 6 carbon atoms which is attached to the silicon atom in the molecule. Examples of the hydrocarbon group include alkyl groups such as methyl, ethyl, propyl, butyl and hexyl groups, cycloalkyl groups such as cyclopentyl and cyclohexyl groups, a phenyl group, and halogenated alkyl groups such as trifluoropropyl and nonafluorohexyl groups, with the methyl group being preferred.

Letters a and b are positive numbers in the range: $0.0001 \leqq a \leqq 0.01$ and $1.95 \leqq a + b \leqq 2.20$. Outside this range, the silicone grease is less resistant against heat.

The amino-modified silicone fluid of formula (1) has an amine equivalent of 10.000 to 200,000 g/mol, preferably 30,000 to 150,000 g/mol. Outside this range, the silicone grease is less resistant against heat.

The amino-modified silicone fluid of formula (1) has a viscosity of 10 to 100,000 cs at 25° C., preferably 20 to 20,000 cs at 25° C. A silicone fluid having a viscosity of less than 10 cs would be difficult to formulate as grease whereas a silicone fluid having a viscosity of more than 100,000 cs would be insufficiently extensible to function as grease.

The organopolysiloxane or amino-modified silicone fluid of formula (1) may be linear, branched or cyclic with the linear one being preferred. Most preferred are organopolysiloxanes of the following average compositional formula (2):

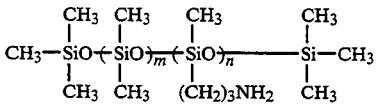

(2)

wherein m is a number of 8 to 1500 and n is a number of 0,002 to 30.

The silicone fluids of formula (2) may be readily prepared by a per se known method, for example, by starting with trimethylsiloxy-terminated polydimethylsiloxane, octamethylcyclotetrasiloxane and methylaminopropylpolysiloxane, polymerizing them at elevated temperature in the presence of a basic catalyst, and subjecting the reaction product to nitrogen-purged vacuum stripping at high temperature for removing low molecular weight siloxanes up to a desired level.

Thickener (B) is used to impart a desired consistency to the silicone grease of the present invention and may be any of conventional well-known ones used for such purposes. Exemplary thickeners include soaps of aliphatic acids having 8 or more carbon atoms with metals such as aluminum, lead, zinc, manganese, lithium, sodium, potassium, calcium, barium, strontium, copper, mercury, bismuth, chromium, iron, and nickel, inorganic fine particulate active oxides such as silica, alumina, iron oxide, titania, zinc oxide, glass fibers and clay, arylurea, phthalocyanine, indanthrene, ethylene tetrafluoride powder, graphite, and carbon black. Preferred among these are lithium soaps such as lithium stearate, lithium hydroxystearate, lithium myristate, and lithium caprate, ethylene tetrafluoride powder, arylurea, silica and clay.

Thickener (B) is preferably blended in amounts of about 2 to 70 parts, more preferably about 5 to 65 parts by weight per 100 parts by weight of silicone fluid (A).

In addition to components (A) and (B), the silicone grease of the present invention may contain any desired additives. Useful additives include antioxidants for imparting stability against oxidation such as isopropoxydiphenylamine and 4-methylene-bis-2,6 -di-t-butylphenol, polar additives for improving lubricity such as tricresyl phosphate, oiliness improvers such as methyl ricinoleate, and anti-rust agents for protecting against rusting of the metal to which the silicone grease is applied, such as benzotriazole.

The silicone grease of the invention is prepared by weighing organopolysiloxane (A) and thickener (B), and mixing them in a mixer such as a planetary mixer while heating if necessary. Preferably mixing is done in a stream of inert gas such as nitrogen gas.

At the end of mixing, the mixture is milled to a uniform finish. Suitable milling means include a three-roll mill, colloid mill, sand grinder, and galling homogenizer, with the three-roll mill being preferred. Other additives may be added either during mixing of components (A) and (B) or during subsequent milling.

EXAMPLE

Examples of the present invention are given below by way of illustration and not by way of limitation. All parts are by weight. The viscosity was measured in centistokes (cs) at 25° C. and physical properties were measured in accordance with JIS K-2220.

Example 1 and Comparative Example 1

A silicone grease (Example 1) was prepared by heat mixing 770 parts of an amino-modified silicone fluid of average compositional formula (3) shown below containing a γ-aminopropyl group in an amine equivalent of 97,000 g/mol and having a viscosity of 311 cs and 230 parts of lithium stearate in a planetary mixer at 195±5° C. for one hour in a nitrogen gas stream. After cooling, to the mixture were added 1 part of isopropoxydiphenylamine, 5 parts of methyl ricinoleate, and 5 parts of tricresyl phosphate. The mixture was fully worked in a three-roll mill until a worked consistency of 250 was reached.

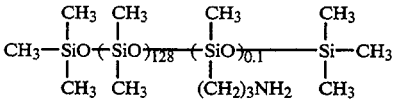

(3)

A silicone grease (Comparative Example 1) having a worked consistency of 252 was prepared by the same procedure as above except that a dimethylsilicone fluid having a viscosity of 300 cs was used as the base oil.

Example 2 and Comparative Example 2

A silicone grease (Example 2) was prepared by thoroughly mixing 650 parts of an amino-modified silicone fluid of average compositional formula (4) shown below containing a N-β-aminoethyl -γ-aminopropyl group in an amine equivalent of 100,000 g/mol and having a viscosity of 10,000 cs and 350 parts of ethylene tetrafluoride powder in a planetary mixer. The mixture was further worked in a three-roll mill until a worked consistency of 285 was reached.

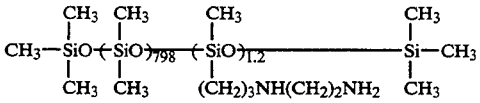

(4)

A silicone grease (Comparative Example 2) having a worked consistency of 290 was prepared by the same procedure as above except that a dimethylsilicone fluid having a viscosity of 10,000 cs was used as the base oil.

Example 3 and Comparative Example 3

A silicone grease (Example 3) was prepared by thoroughly mixing 850 parts of an amino-modified silicone fluid of average compositional formula (5) shown below containing a γ-aminopropyl group in an amine equivalent of 36,000 g/mol and having a viscosity of 100 cs and 150 parts of fumed silica surface treated with $(C_6H_5)_2Si(OH)_2$ in a planetary mixer. The mixture was further worked in a three-roll mill until a worked consistency of 240 was reached.

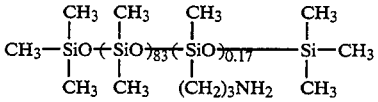

(5)

A silicone grease (Comparative Example 3) having a worked consistency of 235 was prepared by the same procedure as above except that a dimethylsilicone fluid having a viscosity of 100 cs was used as the base oil.

Example 4 and Comparative Example 4

A silicone grease (Example 4) was prepared by heat mixing 790 parts of an amino-modified silicone fluid of average compositional formula (6) shown below containing a N-β-aminoethyl-γ-aminopropyl group in an amine equivalent of 100,000 g/mol and having a viscosity of 315 cs and 210 parts of lithium hydroxystearate in a planetary mixer at 195°±5° C. for two hours in a nitrogen gas stream. After cooling, to the mixture were added 1 part of 4,4 -methylene-bis-2,6 -t-butylphenol, 5 parts of methyl ricinoleate, and 5 parts of tricresyl phosphate. The mixture was worked in a three-roll mill until a worked consistency of 250 was reached.

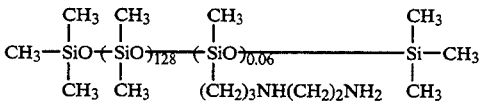

(6)

A silicone grease (Comparative Example 4) having a worked consistency of 245 was prepared by the same procedure as above except that a dimethylsilicone fluid having a viscosity of 300 cs was used as the base oil.

Example 5 and Comparative Example 5

A silicone grease (Example 5) was prepared by thoroughly mixing 800 parts of an amino-modified silicone fluid of average compositional formula (7) shown below containing a γ-aminopropyl group in an amine equivalent of 6,000 g/mol and having a viscosity of 5,000 cs, 200 parts of Benton 34 (organic amine treated clay, manufactured by NL Company ) and 100 parts of acetone in a planetary mixer. The mixture was further worked in a three-roll mill until a worked consistency of 310 was reached.

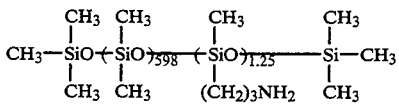

(7)

A silicone grease (Comparative Example 5) having a worked consistency of 315 was prepared by the same procedure as above except that a dimethylsilicone fluid having a viscosity of 5,000 cs was used as the base oil.

The grease samples obtained in Examples 1 to 5 and Comparative Examples 1 to 5 were measured for physical properties and examined by a heat resistance test. Physical properties were measured in accordance with JIS K-2220. The heat resistance test involved maintaining the grease sample in a hot air circulating constant temperature tank at 200° C., and measuring the consistency of the sample after 5 and 10 days using a consistency meter with a $\frac{1}{4}$ scale cup (manufactured by Mitamura Riken Kogyo K.K.), examining a change of consistency with the lapse of time. Fastness against washing was examined in accordance with JIS K-2220 by washing the sample with water at 80° C. for one hour.

The results are shown in Table 1.

TABLE 1

| | | Consistency | | | | Low-temperature torque, g/cm (−50° C.) | | Fastness against washing (%) |
|---|---|---|---|---|---|---|---|---|
| | | unworked | worked | 200° C./5 days worked | 200° C./10 days worked | Starting torque | Running torque | 80° C./1 hr. |
| Example | 1 | 245 | 250 | 166 | 150 | 1300 | 800 | 0.4 |
| | 2 | 275 | 285 | 230 | 224 | 1350 | 950 | 0.1 |
| | 3 | 237 | 240 | 235 | 226 | 1600 | 1450 | 0.1 |
| | 4 | 240 | 250 | 170 | 158 | 1350 | 980 | 0.5 |
| | 5 | 290 | 310 | 220 | 210 | 1550 | 1230 | 0.9 |
| Comparative Example | 1 | 245 | 252 | 67 | 47 | 1400 | 1380 | 2.5 |
| | 2 | 273 | 290 | 200 | 60 | 1450 | 1020 | 1.0 |
| | 3 | 230 | 235 | 210 | 55 | 1630 | 1440 | 0.8 |
| | 4 | 238 | 245 | 63 | 45 | 1360 | 975 | 2.4 |
| | 5 | 285 | 315 | 200 | 45 | 1600 | 1300 | 2.0 |

As is evident from Table 1, silicone grease samples using amino-modified silicone fluids as the base oil according to the present invention were more resistant against heat than the conventional silicone grease samples using dimethylsilicone fluids. Low-temperature properties were equally excellent between the inventive and conventional grease samples.

Although some preferred embodiments have been described, many modifications and variations may be made thereto in the light of the above teachings. It is therefore to be understood that within the scope of the appended claims, the invention may be practiced otherwise than as specifically described.

We claim:

1. A silicone grease comprising (A) an amino-modified silicone fluid of the formula (1);

$$R_a^1R_b^2SiO_{(4-a-b)/2} \quad (1),$$

wherein $R^1$ is a group of the formula: $—R^3—NH_2$ or $—R^3—NHR^4—NH_2$ wherein $R^3$ and $R^4$ are independently alkylene groups having 1 to 8 carbon atoms, $R^2$ is a halogen substituted or unsubstituted monovalent hydrocarbon group having 1 to 6 carbon atoms, letters a and b are positive numbers in the range: $0.0001 \leqq a \leqq 0.01$ and $1.95 \leqq a+b \leqq 2.20$, said silicone fluid having an amine equivalent of 10,000 to 200,000 g/mol and a viscosity of 10 to 100,000 centistokes at 25° C., and (B) a thickener in amounts sufficient to provide a silicone grease.

2. The silicone grease of claim 1 wherein $R^3$ and $R^4$ are independently alkylene groups having 2 or 3 carbon atoms.

3. The silicone grease of claim 1 wherein $R^2$ is a methyl group.

4. The silicone grease of claim 1 wherein said thickener is selected from the group consisting of lithium soaps, ethylene tetrachloride, arylurea, silica and clay.

5. The silicone grease of claim 1 which contains 100 parts by weight of silicone fluid (A) and about 2 to about 70 parts by weight of thickener (B).

6. The silicone grease of claim 1, wherein the silicone fluid has an amine equivalent of 30,000 to 150,000 g/mole and viscosity of 20 to 20,000 centistokes at 25° C.

7. The silicone grease of claim 1, wherein the silicone fluid is an amine-modified organopolysiloxane of the average compositional formula (2):

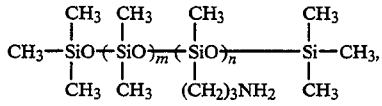

(2)

wherein m is 8 to 1500 and n is 0.002 to 30.

8. The silicone grease of claim 1, wherein the thickener is:

a soap of an aliphatic acid having 8 or more carbon atoms with a metal selected from the group consisting of aluminum, lead, zinc, manganese, lithium, sodium, potassium, calcium, barium, strontium, copper, mercury, bismuth, chromium, iron and nickel;

an inorganic fine particulate active oxide selected from the group consisting of silica, alumina, iron oxide, titania, zinc oxide, glass fibers and clay;

arylurea;

phthalocyanine;

indanthrene;

ethylene tetrafluoride powder;

graphite;

or carbon black.

9. The silicone grease of claim 1, which comprises 5 to 65 parts by weight of the thickener (B) per 100 parts by weight of the silicone fluid (A).

10. A silicone grease consisting essentially of (A) an amino-modified silicone fluid of the formula (1);

$$R_a^1R_b^2SiO_{(4-a-b)/2} \quad (1),$$

wherein $R^1$ is a group of the formula: $—R^3—NH_2$ or $—R^3—NHR^4—NH_2$ wherein $R^3$ and $R^4$ are independently alkylene groups having 1 to 8 carbon atoms, $R^2$ is a halogen substituted or unsubstituted monovalent hydrocarbon group having 1 to 6 carbon atoms, letters a and b are positive numbers in the range: $0.0001 \leqq a \leqq 0.01$ and $1.95 \leqq a+b \leqq 2.20$, said silicone fluid having an amine equivalent of 10,000 to 200,000 g/mol and a viscosity of 10 to 100,000 centistokes at 25° C., and (B) a thickener.

11. The silicone grease of claim 10, wherein $R^3$ and $R^4$ are independently alkylene groups having 2 or 3 carbon atoms.

12. The silicone grease of claim 10, wherein $R^2$ is a methyl group.

13. The silicone grease of claim 10, wherein said thickener is selected from the group consisting of lithium soaps, ethylene tetrachloride, arylurea, silica and clay.

14. The silicone grease of claim 10, which contains 100 parts by weight of silicone fluid (A) and about 2 to 70 parts by weight of thickener (B).

15. The silicone grease of claim 10, wherein the silicone fluid has an amine equivalent of 30,000 to 150,000 g/mole and viscosity of 20 to 20,000 centistokes at 25° C.

16. The silicone grease of claim 10, wherein the silicone fluid is an amine-modified organopolysiloxane of the average compositional formula (2):

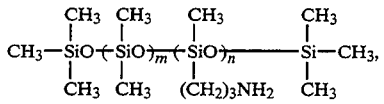

(2)

wherein m is 8 to 1500 and n is 0.002 to 30.

17. The silicone grease of claim 10, wherein the thickener is:

a soap of an aliphatic acid having 8 or more carbon atoms with a metal selected from the group consisting of aluminum, lead, zinc, manganese, lithium, sodium, potassium, calcium, barium, strontium, copper, mercury, bismuth, chromium, iron and nickel;

an inorganic fine particulate active oxide selected from the group consisting of silica, alumina, iron oxide, titania, zinc oxide, glass fibers and clay;

arylurea;

phthalocyanine;

indanthrene;

ethylene tetrafluoride powder;

graphite;

or carbon black.

18. The silicone grease of claim 10, which comprises 5 to 65 parts by weight of the thickener (B) per 100 parts by weight of the silicone fluid (A).

* * * * *